US011051561B1

(12) United States Patent
Goff

(10) Patent No.: US 11,051,561 B1
(45) Date of Patent: Jul. 6, 2021

(54) POCKET BRA SYSTEM

(71) Applicant: Sharon Goff, Hilton Head, SC (US)

(72) Inventor: Sharon Goff, Hilton Head, SC (US)

(73) Assignee: Sherrywear LLC, Hilton Head Island, SC (US)

( * ) Notice: Subject to any disclaimer, the term of this patent is extended or adjusted under 35 U.S.C. 154(b) by 140 days.

(21) Appl. No.: 16/260,217

(22) Filed: Jan. 29, 2019

Related U.S. Application Data

(63) Continuation of application No. 15/679,206, filed on Aug. 17, 2017, now Pat. No. 10,219,550, which is a continuation of application No. 15/045,606, filed on Feb. 17, 2016, now Pat. No. 9,808,036, which is a continuation-in-part of application No. 14/082,777, filed on Nov. 18, 2013, now Pat. No. 9,295,288, which is a continuation-in-part of application No. 13/066,822, filed on Apr. 26, 2011, now Pat. No. 8,597,072.

(51) Int. Cl.
*A41C 3/00* (2006.01)

(52) U.S. Cl.
CPC ..... *A41C 3/0035* (2013.01)

(58) Field of Classification Search
CPC ..... A41C 3/0035; A41C 3/122
USPC ..... 450/89
See application file for complete search history.

(56) References Cited

U.S. PATENT DOCUMENTS

| | | | | |
|---|---|---|---|---|
| 2,624,881 | A | 1/1953 | Dunson | |
| 3,747,545 | A | 7/1973 | Nicolay et al. | |
| 4,263,678 | A | 4/1981 | Off | |
| 4,699,144 | A | 10/1987 | Sherwood | |
| 5,395,280 | A | 3/1995 | Greenberg | |
| 5,496,205 | A | 3/1996 | Lee | |
| 5,799,336 | A | 9/1998 | Cooper | |
| 7,585,200 | B1 * | 9/2009 | McLaren | A41C 3/0035 2/247 |
| 7,753,759 | B2 | 7/2010 | Pintor et al. | |
| 8,257,140 | B2 | 9/2012 | Kenny | |
| 8,597,072 | B1 | 12/2013 | Lucas | |
| 9,289,016 | B1 * | 3/2016 | Goff | A41C 3/122 |
| 9,295,288 | B1 * | 3/2016 | Goff | A41C 3/0035 |
| 9,723,878 | B1 * | 8/2017 | Goff | A41C 3/0035 |
| 9,808,036 | B1 | 11/2017 | Goff | |
| 10,219,550 | B1 * | 3/2019 | Goff | A41C 3/0035 |
| 10,219,551 | B1 * | 3/2019 | Goff | A41C 3/0035 |
| 2008/0032600 | A1 | 2/2008 | Updyke | |

(Continued)

*Primary Examiner* — Gloria M Hale

(74) *Attorney, Agent, or Firm* — Lambert Shortell & Connaughton; David J. Connaughton, Jr.; Justin P. Tinger

(57) ABSTRACT

A strap assembly includes a chest strap and shoulder straps. Similarly configured left and right cups are provided. The strap assembly is attached to the cups whereby the strap assembly adheres the cups to a wearer. Each cup has curved upper, lower, interior and exterior edges. Each cup has inside and outside surfaces. A patch is operatively associated with each cup. Each patch has a linear upper edge and curved lower, interior and exterior edges. Each patch has inside and outside surfaces. Stitching couples the lower, interior and exterior edges of each patch to the lower, interior and exterior edges of an associated cup. A linear opening is formed along the upper edge of each patch. Piping covers the upper edge of each patch. The piping is adapted to allow the patch to move away from and back toward the cup between open and closed orientations.

19 Claims, 6 Drawing Sheets

(56) References Cited

U.S. PATENT DOCUMENTS

| | | | | |
|---|---|---|---|---|
| 2009/0104845 | A1* | 4/2009 | Pintor | A41C 3/0035 450/31 |
| 2009/0209173 | A1* | 8/2009 | Arledge | A41C 3/0035 450/39 |
| 2010/0124869 | A1 | 5/2010 | Liu | |

* cited by examiner

FIG. 4
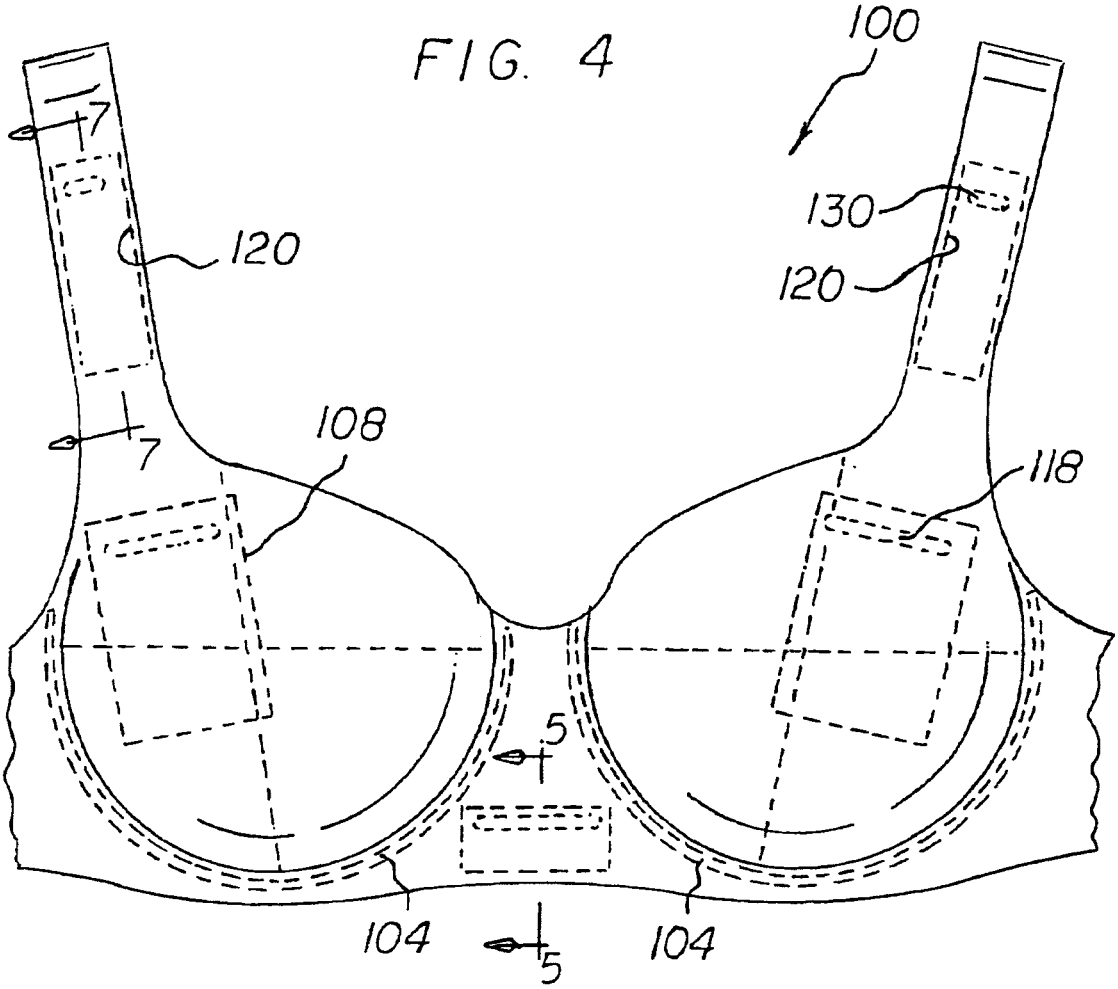
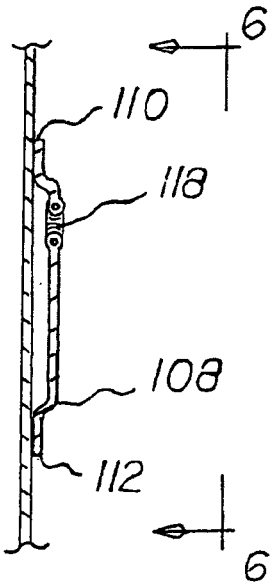
FIG. 5
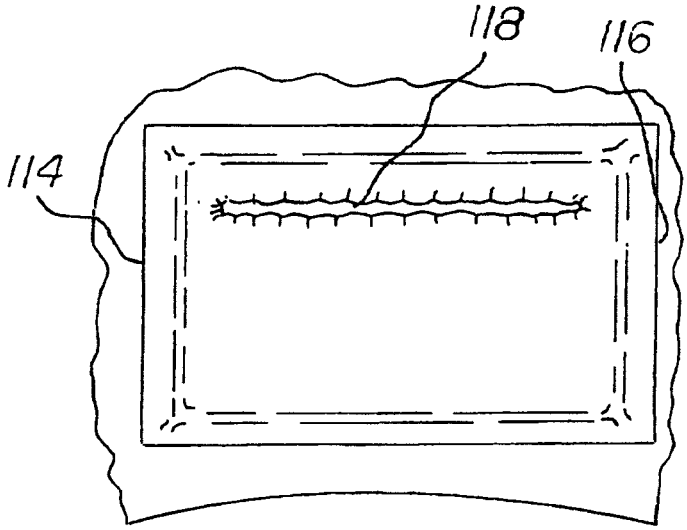
FIG. 6

POCKET BRA SYSTEM

RELATED APPLICATION

The present application is a continuation-in-part of pending application Ser. No. 13/066,822 filed Apr. 26, 2011, the subject matter of which is incorporated herein by reference.

BACKGROUND OF THE INVENTION

Field of the Invention

The present invention relates to a pocket bra system and more particularly pertains to removably receiving a handheld electronic device while providing support and shape to the breasts of a wearer, the receiving and supporting and shaping being done in a safe, convenient and economical manner.

SUMMARY OF THE INVENTION

In view of the disadvantages inherent in the known types of bra systems of known designs and configurations now present in the prior art, the present invention provides an improved pocket bra system. As such, the general purpose of the present invention, which will be described subsequently in greater detail, is to provide a new and improved pocket bra system and method which has all the advantages of the prior art and none of the disadvantages.

To attain this, the present invention essentially comprises a pocket bra system. First provided is a strap assembly which includes a chest strap and shoulder straps. Similarly configured left and right cups are provided. The strap assembly is attached to the cups whereby the strap assembly adheres the cups to a wearer. Each cup has curved upper, lower, interior and exterior edges. Each cup has inside and outside surfaces. A patch is operatively associated with each cup. Each patch has a linear upper edge and curved lower, interior and exterior edges. Each patch has inside and outside surfaces. Stitching couples the lower, interior and exterior edges of each patch to the lower, interior and exterior edges of an associated cup. A linear opening is formed along the upper edge of each patch. Piping covers the upper edge of each patch. The piping is adapted to allow the patch to move away from and back toward the cup between open and closed orientations.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pocket bra system which has all of the advantages of the prior art bra systems of known designs and configurations and none of the disadvantages.

It is another object of the present invention to provide a new and improved pocket bra system which may be easily and efficiently manufactured and marketed.

It is further object of the present invention to provide a new and improved pocket bra system which is of durable and reliable constructions.

An even further object of the present invention is to provide a new and improved pocket bra system which is susceptible of a low cost of manufacture with regard to both materials and labor, and which accordingly is then susceptible of low prices of sale to the consuming public, thereby making such pocket bra system economically available to the buying public.

Even still another object of the present invention is to provide a pocket bra system for removably receiving a handheld electronic device while providing support and shape to the breasts of a wearer, the receiving and supporting and shaping being done in a safe, convenient and economical manner.

Lastly, it is an object of the present invention to provide a new and improved pocket bra system for removably receiving a handheld electronic device and other objects while providing support and shape to the breasts of a wearer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred and alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a front elevational view of a pocket bra system constructed in accordance with an alternate embodiment of the invention.

FIG. 5 is a cross sectional view taken along line 5-5 of FIG. 4.

FIG. 6 is a rear elevational view taken along line 6-6 of FIG. 5.

The same reference numerals refer to the same parts throughout the various Figures.

DESCRIPTION OF THE PREFERRED EMBODIMENT

Figure 1:
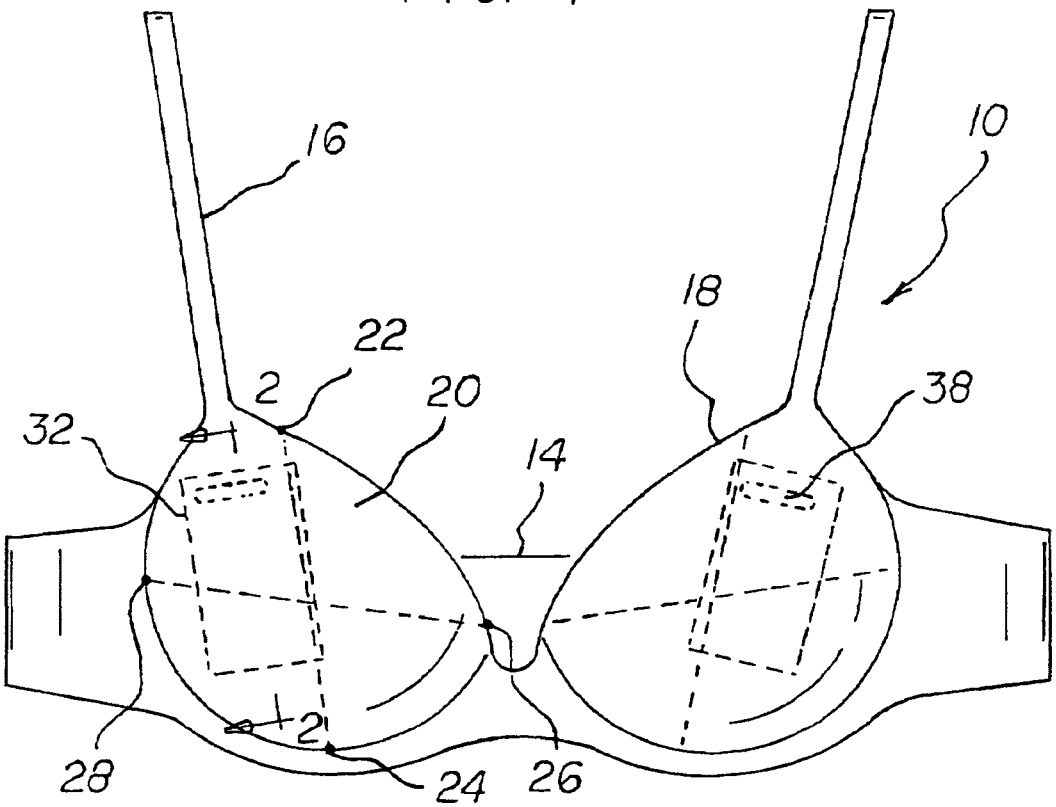
FIG. 1 is a front elevational view of a pocket bra system constructed in accordance with the principles of the present invention.
Figure 2:
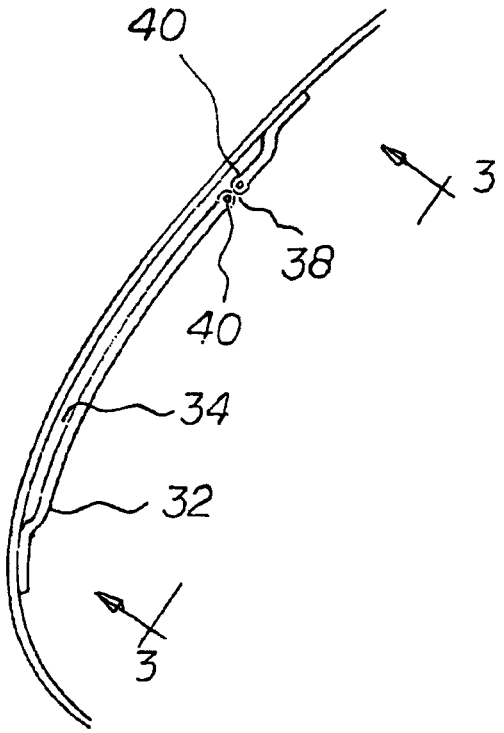
FIG. 2 is a cross sectional view taken along line 2-2 of FIG. 1.
Figure 3:
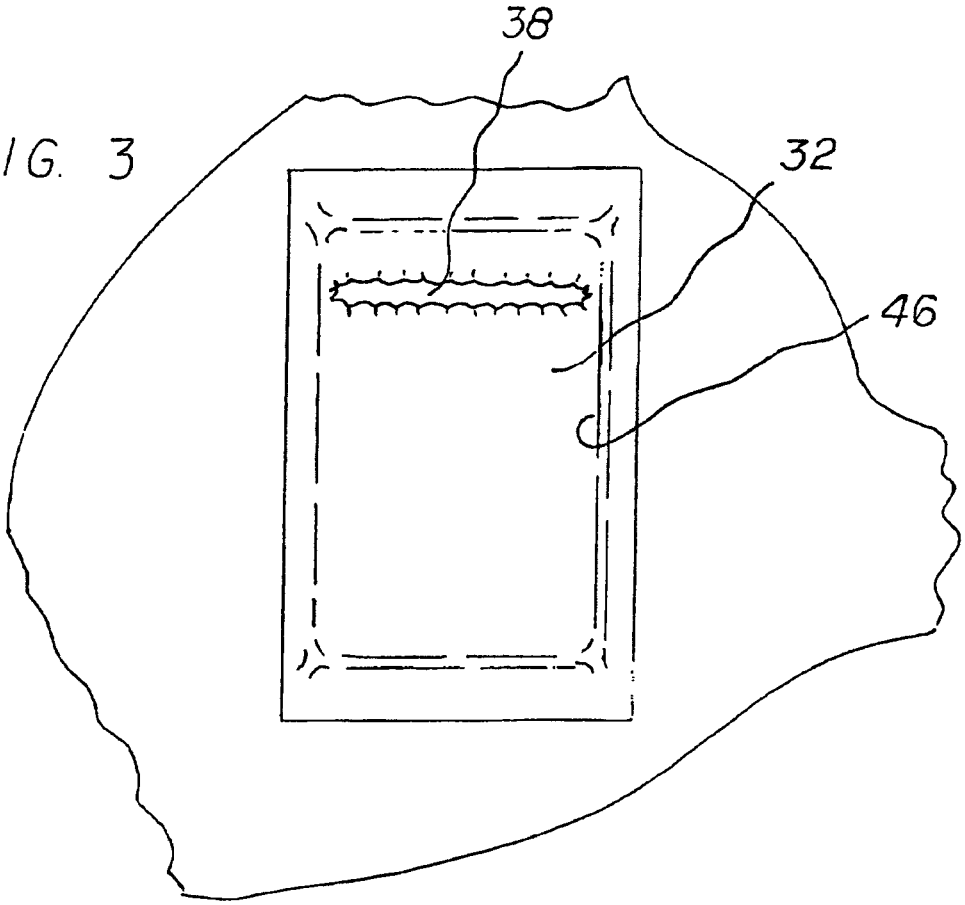
FIG. 3 is a rear elevational view taken along line 3-3 of FIG. 2.
Figure 7:
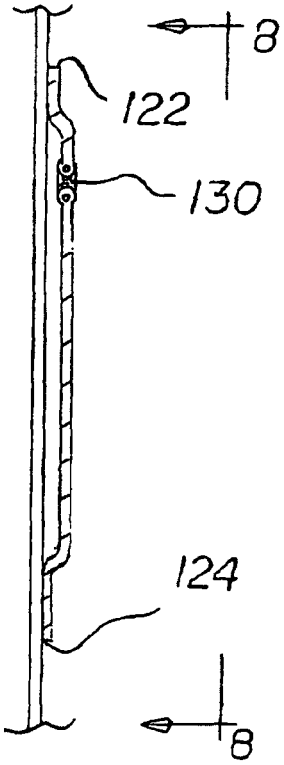
FIG. 7 is a cross sectional view taken along line 7-7 of FIG. 4.
Figure 8:
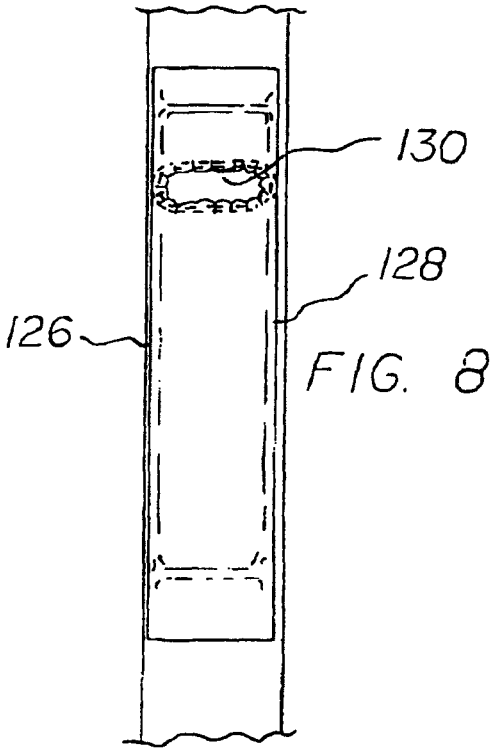
FIG. 8 is a rear elevational view taken along line 8-8 of FIG. 7.

With reference now to the drawings, and in particular to FIG. 1 thereof, the preferred embodiment of the new and improved pocket bra system embodying the principles and concepts of the present invention and generally designated by the reference numeral 10 will be described.

The present invention, the pocket bra system 10 is comprised of a plurality of components. Such components in their broadest context include a strap, left and right cups, a rectangular patch and a linear slit. Such components are individually configured and correlated with respect to each other so as to attain the desired objective.

First provided is a strap assembly. The strap assembly includes a generally horizontal chest strap 14. The chest strap is positionable around the chest and back of a wearer. The strap assembly includes left and right generally vertical shoulder straps 16. The shoulder straps are positionable over the shoulders of the wearer. The shoulder straps have free ends. The free ends are coupled to the chest strap adjacent to the chest of the wearer and adjacent to the back of the wearer.

A left cup 18 is provided. A similarly configured right cup 20 is provided. Each cup has an inside surface and an outside surface. The left and right cups each have an upper-most point 22. The left and right cups each have a lower-most point 24. A generally vertical axis is provided. The vertical axis divides each cup into an inner hemisphere interiorly and an outer hemisphere exteriorly. The left and right cups each have an inner-most point 26. The left and right cups each have an outer-most point 28. A generally horizontal axis is provided. The horizontal axis divides each cup into an upper hemisphere above and a lower hemisphere below.

A rectangular patch 32 is provided next. The patch is operatively associated with each cup. Each patch has generally horizontal upper and lower edges. Each patch has generally vertical interior and exterior edges. The patch has a periphery. The periphery has stitching. In this manner the periphery of each patch is coupled to the inside surface of an associated cup. The majority of each patch is in the upper hemisphere. The majority of each patch is in the outer hemisphere. A rectangular chamber 34 is provided. The chamber is provided between each patch and its associated cup. The chamber is rectangular. The chamber has a height of 120 and 140 millimeters. The chamber has a width of between 60 and 70 millimeters. The pockets are fabricated of a resilient closed cell polyurethane foam. The foam has a thickness of from 2 to 4 millimeters. The patches are fabricated of an elastic fabric.

Further provided is a linear slit 38. The slit is provided in each patch. The slit is provided parallel with, and closely spaced from, the upper edge of each patch. Each slit has a length greater than 90 percent of the width of the chamber. An elastic band 40 is provided. The elastic band is provided within each patch. The elastic band surrounds the slit. The elastic band is adapted to return the slit to a closed orientation. The elastic band is further adapted to allow the slit to stretch to an enlarged orientation.

Provided last is a handheld electronic device 46. The handheld electronic device is positionable within the chamber. The handheld electronic device has a height of 115 millimeters, plus or minus 10 percent. The handheld electronic device has a width of 59 millimeters. The handheld electronic device has a thickness of 9 millimeters plus or minus 10 percent. The slit is adapted to stretch to the open orientation when adding the handheld device to, or removing the handheld device from, the chamber. The slit is adapted to contract to the closed orientation when the handheld device is within or without the chamber. The thickness and the material of the cups and the patches are adapted to abate inward projections by the handheld devices in the chambers tending to poke a user. The thickness and the material of the cups and the patches are adapted to abate outward projections by the handheld devices in the chambers tending to create unsightly projections.

An alternate embodiment 100 of the present invention is provided. An under-wire 104 is provided. The under-wire is provided beneath each cup.

A central patch 108 is provided. The central patch is provided intermediate the cups. In this manner a central chamber is formed. The central patch has horizontal upper and lower edges 110, 112. The central patch has vertical side edges 114, 116. The upper and lower edges are longer than the side edges. The central patch has a central slit 118. The central slit is provided parallel with and in proximity to the upper edge. The central chamber is adapted to receive and support keys.

An upper patch 120 is provided on each shoulder strap. The upper patches have horizontal upper and lower edges 122, 124. The upper patches have vertical side edges 126, 128. The upper and lower edges are shorter than the side edges. The upper patches each have an upper slit 130. The upper slit is provided parallel with and in proximity to the upper edge. The upper chambers are adapted to receive and support pills.

FIGS. 9 through 12 illustrate a system 200 constructed in accordance with another alternate embodiment of the invention. In such alternate embodiment, enlarged bra pockets 202 are constructed on the cups of the bra. In addition, side pockets 204 are constructed along both sides of the bra. Although only a right side pocket is illustrated, it should be understood that a similarly constructed left side pocket is preferably provided additionally.

Figure 9:
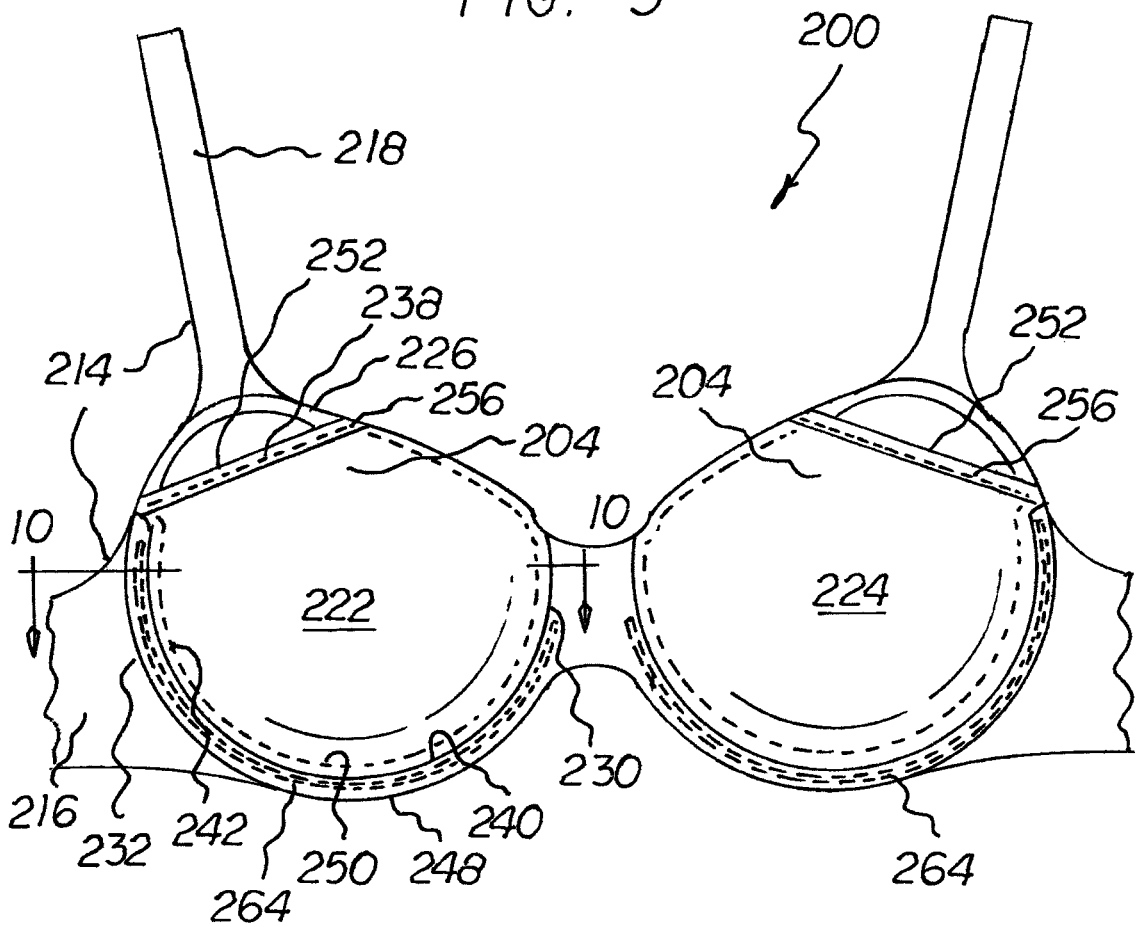
FIG. 9 is a front elevational view of a pocket bra system constructed in accordance with another alternate embodiment of the invention.
Figure 10:
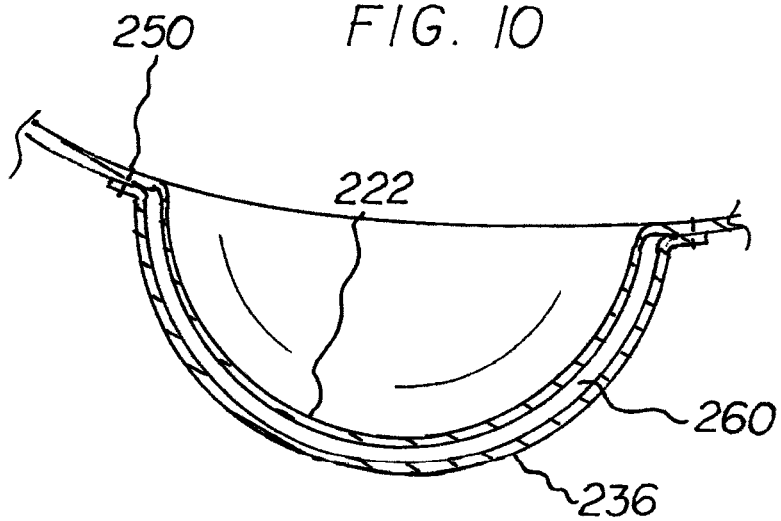
FIG. 10 is a cross sectional view taken along line 10-10 of FIG. 9.
Figure 11:
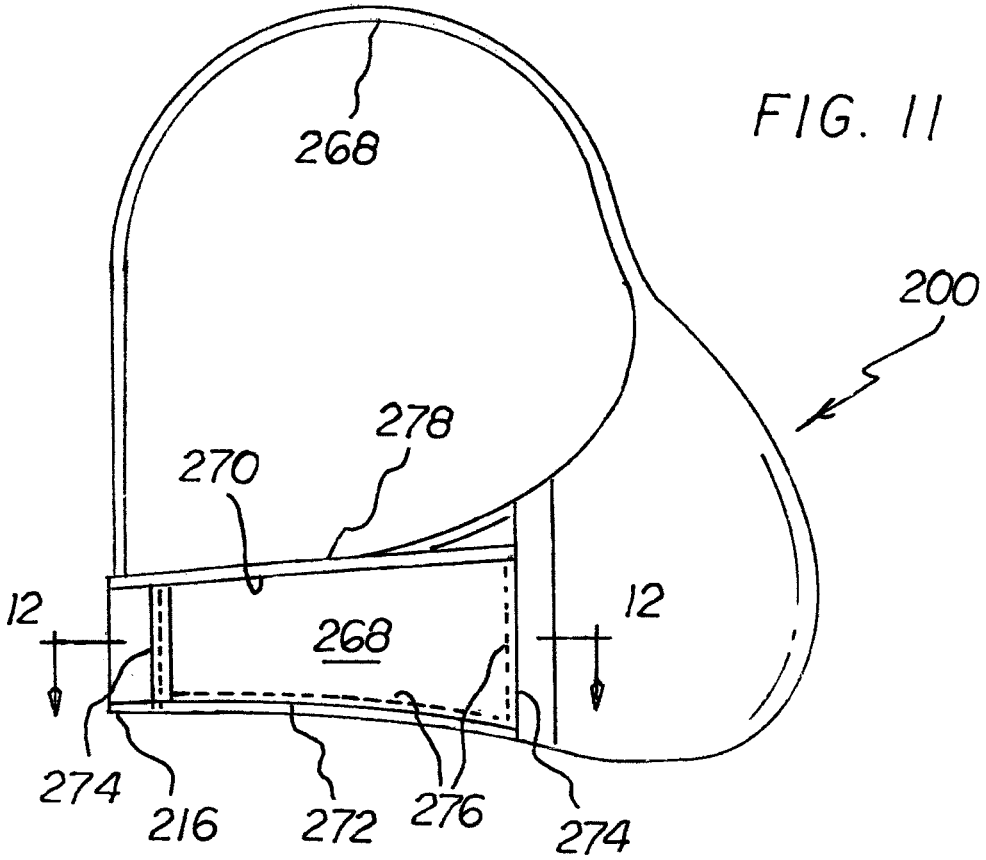
FIG. 11 is a side elevational view of the pocket bra system shown in FIGS. 9 and 10.
Figure 12:
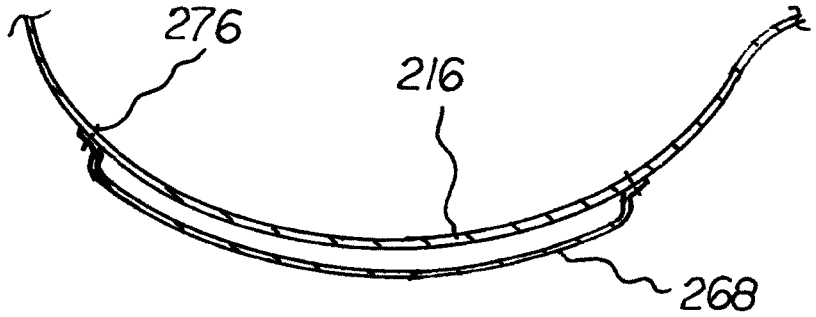
FIG. 12 is a cross sectional view taken along line 12-12 of FIG. 11.

As shown in FIGS. 9 and 10, there is illustrated a pocket bra system 200 for removably receiving a handheld electronic device and other objects while providing support and shape to the breasts of a wearer. The system includes a strap assembly 214. The strap assembly is formed of a chest strap 216 and shoulder straps 218.

Next provided are similarly configured left and right cups 222, 224. Each cup has inside and outside surfaces. The strap assembly is attached to the cups whereby the strap assembly adheres the cups to a wearer. Each cup has curved upper edge 226, a lower edge 228, an interior edge 230 and an exterior edge 232. Each cup has inside and outside surfaces.

A patch 236 is operatively associated with each cup. Each patch has a linear upper edge 238 and a curved lower edge 240, an interior edge 242 and an exterior edge 248. Each patch has inside and outside surfaces.

Stitching 250 couples the lower, interior and exterior edges of each patch to the lower, interior and exterior edges of an associated cup. A linear opening 252 is thus formed along the upper edge of each patch. Piping 256 covers the upper edge of each patch. The upper edge of the patch and the piping are adapted to allow the patch to move away from and back toward the cup between open and closed orientations.

Pockets 260 are formed between the patches and the cups. The cups are preferably fabricated of a resilient closed cell polyurethane foam with a thickness of from 2 to 4 millimeters. The patches are also preferably fabricated of a resilient closed cell polyurethane foam with a thickness of from 2 to 4 millimeters.

A handheld electronic device 46 is adapted to be placed within a pocket.

An under-wire 264 is coupled beneath each cup in a generally vertical plane.

Lastly provided is a side patch 268 on each side of the chest strap. The side patches each have a horizontal upper edge 270 and a lower edge 272 and vertical side edges 274. The upper and lower edges of each patch are longer than the side edges. The side patches include side stitching 276 along the lower and side edges. Thus is formed an upper opening 278 at each side patch.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pocket bra comprising:

a strap assembly comprising a chest strap and two shoulder straps, and comprising left and right cups, each cup being an area to receive a breast of a wearer and having inside and outside surfaces, the strap assembly being attached to the cups whereby the strap assembly is operable to connect the cups to the wearer, each cup having upper, lower, interior body facing, and opposite exterior edges;

a pocket on one of the two shoulder straps, the pocket having an opening capable of repeated receiving and removal of an item when being worn by the wearer; and wherein the pocket is positioned on an outside surface of the one of the two shoulder straps such that it is facing away from the wearer when the pocket bra is worn.

2. The pocket bra of claim 1 wherein the pocket is formed by a layer attached to the one of the two shoulder straps.

3. The pocket bra of claim 2 wherein the layer is attached to the one of the two shoulder straps by a stitching about a patch lower edge and two side edges.

4. The pocket bra of claim 2 wherein the layer comprises a slit, the slit being the opening to the pocket.

5. The pocket bra of claim 1 wherein the pocket is adapted to receive and support pills.

6. The pocket bra of claim 1 further comprising an item positioned within the pocket.

7. The pocket bra of claim 1 wherein the pocket is formed of an elastic fabric.

8. The pocket bra of claim 1 further comprising a second pocket positioned on one of the left and right cups.

9. The pocket bra of claim 8 wherein the second pocket is formed by a layer operatively associated with the one of the left and right cups, the layer having an upper edge, a lower edge, and an exterior edge, the layer having inside and outside surfaces.

10. The pocket bra of claim 9 wherein the lower edge of the layer is coupled to the bra adjacent to a lower edge of the one of the left and right cups, and the exterior edge of the layer coupled adjacent to the exterior edge of the one of the left and right cups, a pocket opening formed along the upper edge of the layer being unconnected to the at least one of the left and right cups.

11. The pocket bra of claim 10 wherein the upper edge of the layer crosses over a surface of the cup to form the opening, the upper edge crossing such that the opening faces the exterior edge of the one of the left and right cup to which it is attached.

12. The pocket bra of claim 10 wherein the upper edge of the layer crosses over a surface of the cup to form the opening, the upper edge crossing such that the opening faces an interior edge of the one of the left and right cup to which it is attached.

13. The pocket bra of claim 1 further comprising a second pocket on the other of the two shoulder straps.

14. The pocket bra of claim 1 wherein the pocket further comprises a closure.

15. A pocket bra comprising:

a strap assembly comprising a chest strap and two shoulder straps, and comprising left and right cups, each cup being an area to receive a breast of a wearer and having inside and outside surfaces, the strap assembly being attached to the cups whereby the strap assembly is operable to connect the cups to the wearer, each cup having upper, lower, interior body facing, and opposite exterior edges;

a pocket on one of the two shoulder straps, the pocket having an non-sealing opening capable of repeated receiving and removal of an item when being worn by the wearer;

wherein the pocket is formed by a layer of one of the two shoulder straps the layer comprises a slit, the slit being the opening to the pocket.

16. The pocket bra of claim 15 wherein the layer, at a point adjacent to the slit, prevents items from falling out.

17. The pocket bra of claim 14 wherein items can be inserted into the closure with enough force to stretch the bottom edge of the layer.

18. The pocket bra of claim 15 wherein the pocket is positioned on an inside surface of the one of the two shoulder straps such that it is facing the wearer when the pocket bra is worn.

19. A pocket bra comprising:

a strap assembly comprising a chest strap and two shoulder straps, and comprising left and right cups, each cup being an area to receive a breast of a wearer and having inside and outside surfaces, the strap assembly being attached to the cups whereby the strap assembly is operable to connect the cups to the wearer, each cup having upper, lower, interior body facing, and opposite exterior edges;

a pocket on one of the two shoulder straps, the pocket having an opening capable of repeated receiving and removal of an item when being worn by the wearer;

wherein no sealing device is attached to the opening.

* * * * *